United States Patent [19]

Smithey

[11] Patent Number: 4,751,616

[45] Date of Patent: Jun. 14, 1988

[54] DOUBLE REVERSE CHEMILUMINESCENT LIGHTING DEVICE

[75] Inventor: Walter A. Smithey, Santa Rosa, Fla.

[73] Assignee: American Cyanamid Company, Stamford, Conn.

[21] Appl. No.: 1,080

[22] Filed: Jan. 7, 1987

[51] Int. Cl.[4] ..... F21K 2/06
[52] U.S. Cl. ..... 362/34; 252/700
[58] Field of Search ..... 362/34; 252/700

[56] References Cited

U.S. PATENT DOCUMENTS

| | | | |
|---|---|---|---|
| 3,888,786 | 6/1975 | Maudling | 252/700 |
| 3,974,368 | 8/1976 | Rauhut | 362/34 |
| 4,640,193 | 2/1987 | Koroscil | 362/34 |

*Primary Examiner*—Larry I. Schwartz
*Attorney, Agent, or Firm*—Frank M. Van Riet

[57] ABSTRACT

Self-contained device for providing chemiluminescent light comprising a light transmitting frangible inner container containing a diluent solution of an oxalate, a fluorescer and a catalyst and an outer container containing a diluent solution of a peroxide.

26 Claims, No Drawings

DOUBLE REVERSE CHEMILUMINESCENT LIGHTING DEVICE

BACKGROUND OF THE INVENTION

Under certain circumstances, it is desirable to have a source of visible light which is not electrically activated. Light can be provided by chemical systems, wherein the luminosity is solely the result of chemical reaction without provision of any electrical energy. Such light is known as chemiluminescent light.

Chemiluminescent light may be useful where there is no source of electricity. For example, in emergencies where sources of electrical power have failed, a chemiluminescent system could provide light. Such emergencies could occur in a crash landing of an aircraft, a power failure in a submarine or in underground installations or during any electrical power failure. Moreover, chemiluminescent light is cold light and can be used where the heat of conventional illumination is not desired. It is also useful where electrical means could cause a fire hazard, such as in the presence of inflammable agents. Chemiluminescent light is also effective under water since there are no electrical connections to short out. Thus it may be seen that chemiluminescent light can have many useful applications.

Devices which employ the principles of chemiluminescent light have been commercially available in the worldwide marketplace for many years. These devices provide an excellent source of non-electric light and have become exceedingly popular especially for emergency and outdoor use.

Most of these commercially available devices are sold packaged in a protective foil wrapper. This wrapper is moisture and light impervious and functions to maintain the integrity of the chemiluminescent components which tend to deteriorate over a period of time without such protection Offtimes, however, the protective wrapper is damaged during shipment, storage, production, etc. or while on display for sale.

Damage to the protective wrapper, of course, allows moisture and light to permeate the device and degrade the chemiluminescent components to such a degree that the light produced upon activation of the device is of less intensity and duration than would otherwise be attained.

Attempts to do away with the protective wrapper or otherwise provide a different, more secure, wrapper or packaging system have, until the present invention, proven less than satisfactory.

Thus, the provision of a means for eliminating a protective wrapper for chemiluminescent devices or a different means for the protection, therefor would satisfy a longfelt need in the industry.

SUMMARY OF THE INVENTION

A chemiluminescent light device has been devised whereby the need for a protective wrapper is eliminated. The device employs an inner container in which is contained a diluent solution of an oxalate, a fluorescer and a catalyst and an outer container in which is contained a diluent solution of a peroxide.

DESCRIPTION OF THE INVENTION INCLUDING PREFERRED EMBODIMENTS

The degradation of the components of chemiluminescent light systems due to moisture and light has necessitated the packaging of devices containing said systems in foiled wrappers. The oxalate is the component of the system which is most deleteriously affected by moisture however, both yellow and blue fluorescers and salicylate catalysts may also be affected. The instant invention provides a chemiluminescent light device and method for the prevention of the deterioration of chemiluminescent chemicals present therein.

Furthermore, it has now been found that minor deleterious effects which result to components of the chemiluminescent light systems by being in continual contact with each other or with the container in which they are contained are also obviated by the present invention. Thus, the neutralization of salicylate catalyst by the peroxide; the hydrolysis or other decomposition of the diluents which may also affect the catalyst and the impurities which oftimes are present in polymers from which the containers are made, e.g. polyethylene, which affect the functionality of the oxalates are also reduced by the invention set forth herein.

A further advantage realized by the present invention resides in the use of a lesser concentrated peroxide solution in the device. Peroxides are chemicals which may be hazardous to individuals who are unaware of their potential. Thus, violation of the integrity of a device to the extent that the chemical solutions are removed from the device presents a greater hazard to the remover as the concentration of the solution of peroxide increases. The present invention enables substantially the same degree of chemiluminescent light to be achieved of substantially the same duration with a lower concentrated solution of peroxide than present in commercially available devices.

It has also been found that by placement of the catalyst in the oxalate solution, catalytic deterioration due to heat is reduced thus rendering the device more thermally stable.

A typical commercially available chemiluminescent device of the dual ampoule variety contains a diluent solution of oxalate and fluorescer in the outer container and a diluent solution of hydrogen peroxide and catalyst in the inner container. Typical devices are disclosed in one or more of the following U.S. Pat. Nos. 3,511,612; 3,539,794; 3,576,987; 3,584,211; 3,654,525; 3,749,620; 3,752,406; 3,800,132; 3,808,414; 3,940,604; 3,974,368; 4,064,428; each of which is hereby incorporated herein by reference.

In accordance with the present invention, there is provided a chemiluminescent light device comprising at least two containers each of which is sealed and each of which contain a chemical component of a multicomponent chemiluminescent system, said containers comprising a light transmitting outer container and at least one rigid frangible inner container, wherein said outer container has contained therein a diluent solution of peroxide and the inner container has contained therein a diluent solution of an oxalate, a fluorescer and a catalyst.

The concentrations of the individual chemicals which comprise the chemiluminescent components which are contained in the individual ampoules of the device are varied in accordance with the present invention as compared to those of commercially available devices. The total concentrations or ratio of concentration of one chemical to another chemical, upon activation of the device, i.e., mixing of the contents of the individual containers or ampoules, remains the same.

Thus, the outer container has contained therein an activator comprising a diluent solution of from about 1.60 to about 2.0%, based on the total weight of the activator, of a peroxide and the inner container has contained therein a second diluent solution of from about 10–20% of oxalate, 0.1–0.5% of fluorescer and 0.006 to 0.01% of catalyst, all by weight, based on the total weight of the second diluent solution. The concentration of each individual chemical, of course, varies as the chemical varies, e.g., different fluorescers require different concentrations.

The peroxides employed in the components of this invention may be any hydroperoxide compound. Typical hydroperoxides include t-butylhydroperoxide, peroxybenzoic acid, and hydrogen peroxide. Hydrogen peroxide is the preferred hydroperoxide and may be employed as a solution of hydrogen peroxide in a solvent or as a anhydrous hydrogen peroxide.

Whenever hydrogen peroxide is contemplated to be employed, any suitable compound may be substituted which will produce hydrogen peroxide.

The peroxide is preferably employed as a solution in a diluent.

Typical diluents in are those which do not readily react with a peroxide such as hydrogen peroxide. Typical diluents include t-butyl alcohol, ethanol, octanol, diethyl ether, diamyl ether, tetrahydrofuran, dioxane, dibutyldiethyleneglycol, perfluoropropyl ether, and 1,2-dimethoxyethane, ethyl acetate, ethyl benzoate, dimethyl phthalate, dibutylphthalate, propyl formate and the like. Diluent combinations are also useful and a preferred diluent for the peroxide is a mixture of dibutyl phthalate and t-butyl alcohol, see U.S. Pat. No. 4,313,843, hereby incorporated herein by reference.

The chemiluminescent light is obtained by the reaction of the hydrogen peroxide of the activator solution with the chemiluminescent composition which comprises the oxalate fluorescer and catalyst. Suitable oxalates are disclosed and claimed in U.S. Pat. Nos. 3,597,392; 3,749,679 hereby incorporated herein by reference and in those patents set forth hereinabove. Typical oxalates include bis(2-nitrophenyl)oxalate, bis(2,4-dinitrophenyl)oxalate, bis(2,6-dichloro-4-nitrophenyl-)oxalate, bis(2,4,6-trichlorophenyl)oxalate, bis(3-trifluoromethyl-4-nitrophenyl)oxalate, bis(2-methyl-4,6-dinitrophenyl)oxalate, bis(1,2-dimethyl-4,6-dinitrophenyl)oxalate, bis(2,4-dichlorophenyl)oxalate, bis(2,5-dinitrophenyl)oxalate, bis(2-formyl-4-nitrophenyl)oxalate, bis(pentachlorophenyloxalate, bis(1,2-dihydro-2-oxo-1-pyridyl)glyoxal, bis-N-phthalmidyl oxalate. The preferred oxalate, is bis(2,4,5-trichloro-6-carbopentoxyphenyl)oxalate.

Typical suitable fluorescent compounds for use in the present invention are those which have a spectral emission falling between 330 millimicrons and 1000 millimicrons and which are soluble in any of the above diluents. Typical fluorescers are those of U.S. Pat. Nos. 3,557,233; 3,888,786 and those above hereby incorporated herein by reference and including rubrene; N,N$^1$-bis(2,5-di-t-butylphenyl)-3,4,9,10-perylenedicarboximide; 9,10-diphenylanthracene; 1-chloro-9,10-bis(-phenylethynyl)anthracene; 9,10-bis(4-methoxyphenyl)-2-chloroanthracene, the latter three of which are preferred.

The catalysts useful herein are also well known in the art as exemplified by the above-referenced patents. Sodium salicylate; sodium-5-bromosalicylate; sodium-5-chlorosalicylate; sodium-5-fluorosalicylate; lithium salicylate and rubidium acetate are suitable herein. Sodium salicylate is preferred.

Those diluents discussed above with regard to the peroxide solutions are also useful as diluents in the oxalate-fluorescer-catalyst solutions. Dibutyl phthalate is preferred.

Other additives such as decelerators, stabilizers for any of the chemicals, ultraviolet light absorbers, etc. may be added to one or more of the solutions without detracting from the scope of the present invention.

The present invention is a self-contained chemiluminescent light device. In its broadest aspects, in the present invention, the reactive components are stored in a multiple compartment container device at least one of which is light transmitting, that is transparent or translucent to the chemiluminescent light, having means to bring the separate components into contact to produce the reaction which provides chemiluminescent light and means to display the fluid in said transparent container.

Means are provided to bring the components in each compartment together in a transparent compartment and to display the combined components as a chemiluminescent light mixture. The translucent container in which light mixture may be mixed may be of any desired configuration to provide visible light in various display forms. It will be understood that the term light transmitting is intended to include both transparent and translucent and the use of either of these terms is intended to include the other. Thus, the inventive device comprises a closed container which is light transmitting for containing and displaying a chemiluminescent mixture and additional means to maintain the components of the mixture separated and nonreactive until the light display is desired. The device preferably has an outer transparent container, flexible or rigid, which contains a separate inner container being rupturable or openable by means external of the outer container.

Preferably, the outer container is made of plastic with polyethylene and polypropylene being exemplary and the inner container is a frangible material such as glass, but need not be light transmitting.

Thus modifications, changes and combinations of the embodiments illustrated will be obvious. Moreover, it will be obvious that any suitable material may be used for the containers, so long as the containers or the final chemiluminescent light mixture is light transmitting and closed. The materials should also be inert and impervious to the chemiluminescent components. In addition, the plastic sheet material may be of more than one layer and type of plastic as required by the intended use, environment and chemiluminescent components.

The invention provides systems and devices for providing visible light whenever and wherever desired, independent of conventional electrical lighting methods and without the hazards of electric lighting. The chemiluminescent lighting systems can be especially useful in emergency situations where all other forms of lighting have failed. The systems do not have the fire hazard of ignitable lighting devices such as candles, gas, or oil lights.

It will be readily apparent that the chemiluminescent systems are not confined to emergency lighting, however. They can be used at any time where a cold, safe illuminating means is desired. They are also useful to provide illumination where electrical illumination is unavailable. Such systems can also be made highly portable. Moreover, the applications are varied and numerous in view of the possibility of using configurated display means and the ability of the chemiluminescent composition to take such configurated forms due to its fluid state.

The present invention also encompasses a method for the prevention of the deterioration of the catalyst, oxalate or fluorescer in a chemiluminescent light device comprising at least two containers each of which is sealed and each of which contains a chemical component of a multicomponent chemiluminescent system, said containers comprising a light transmitting outer container and at least one rigid frangible inner container located within said outer container which comprises sealing within said outer container a diluent solution of a peroxide and sealing within said inner container a diluent solution of an oxalate, a fluorescer and a catalyst.

The following examples are set forth for purposes of illustration only and are not to be construed as limitations on the present invention except as set forth in the appended claims. All parts and percentages are by weight unless otherwise specified.

The following sets forth the ingredients and concentrations thereof comprising the peroxide solution used in the outer container of the devices of the present invention of the following examples. In each instance, the device is a 6" outer container having a glass ampoule inner container positioned therein and containing the chemiluminescent solutions of the following examples. The components of the activator solution of an inner container of a commercially available chemiluminescent device (over which the instant invention is an improvement) is also known.

| Outer Container Ingredients of Device of this invention (All Examples) | | Inner Container Ingredients of Commercial Devices (All Examples) | |
|---|---|---|---|
| Dibutyl Phthalate | 89.03% ± 4.2% | Dimethyl-phthalate | 81.48% |
| T-butyl alcohol | 9.00% ± 4.0% | T-butyl Alcohol | 13.30% |
| 90% Aqueous $H_2O_2$ | 1.80% ± 0.2% | 90% Aqueous $H_2O_2$ | 5.22% |
| Sodium Salicylate | — | Sodium Salicylate | 0.0091% |
| Usage in Device | 7 parts ± 2 parts | 2.8 parts | |

EXAMPLE I

Chemiluminescent Yellow

| Inner Container Ingredients of Device of this Invention (Device II) | | Outer Container Ingredients of Commercial Device (Device III) | |
|---|---|---|---|
| Dibutyl Phthalate | 82.6% | Dimethyl Phthalate | 88.64% |
| CPPO | 17.0% | CPPO | 11.10% |
| CBPEA | 0.4% | CBPEA | 0.26 |
| Sodium Salicylate | 0.1% | — | — |
| Inner Container 3.5 parts | | Inner Container 2.8 parts | |
| Outer container 5.4 parts | | Outer container 7.8 parts | |

CPPO = bis(2,4,5-trichloropentyl-6-carbopentoxylphenyl)oxalate
CBPEA = 1-chloro-9,10-bis(phenylethynyl)anthracene The resultant devices are both subjected to "Baseline" and accelerated aging tests to determine the effectiveness of the resultant yellow chemiluminescent light generated upon activating the device by breaking the inner container and shaking. The accelerated aging test is conducted by subjecting a non-activated device to up to 96 hours at 65° C. to 100% relative humidity in the absence of outer foil packaging. The light output is then measured for virgin devices after 10 minutes (Baseline) and those subjected to aging after cooling to room temperature. The results are set forth in Table I, below.

TABLE 1

| | Baseline | | Accelerated Aging 72 hours | | Accelerated Aging 96 hours | |
|---|---|---|---|---|---|---|
| | Device I | Device II | Device I | Device II | Device I | Device II |
| Light Output in lumens/liter at activation | 2,000 | 2,000 | 0 | 2,000 | 0 | 2,000 |
| Total Light Output in lumens liter$^{-1}$ minutes (for 10–720 minutes) | 20,920 | 20,465 | 16,590 | 17,310 | 14,990 | 17,970 |

As can be readily appreciated, the device of the present invention shows a Baseline light output substantially the same as the commercial device, however, the commercial device fails to produce any light output until after 10 minutes when aged 72–96 hours whereas the instant devices produce immediate light and a greater amount of light over the period of time of 10–720 minutes.

EXAMPLE II

Chemiluminescent Blue

| Inner Container Ingredients of Device of this Invention (Device IV) | | Outer Container Ingredients of commercial Device (Device III) | |
|---|---|---|---|
| Dibutyl Phthalate | 82.732% | | 91.28% |
| CPPO | 17.000% | | 8.60% |
| BPEN | 0.260% | | 0.12% |
| Sodium Salicylate | 0.008% | | — |
| Inner Container 3.18 parts | | Inner Container 2.8 parts | |
| Outer Container 7.42 parts | | Outer Container 7.8 parts | |

CPPO = see Ex. 1
BPEN = 9,10-bis(4-methoxyphenyl)-2-chloroanthracene

The testing procedure of Example 1 is followed in order to test the above devices under the conditions specified. The results are set forth in Table II, below.

TABLE II

| | Baseline | | Accelerated Aging 48 hours | | Accelerated Aging 72 hours | |
|---|---|---|---|---|---|---|
| | Device III | Device IV | Device III | Device IV | Device III | Device IV |
| Light Output in lumens/liter (at activation) | 2,000 | 2,000 | 180 | 2,000 | * | 2,000 |
| Total light Output in lumens liter$^{-1}$ minutes (for 10–480 minutes) | 20,620 | 18,185 | 10 | 19,120 | * | 17,520 |

* = leakage occurred before 72 hours

Again, the device of the present invention exceeds that of the commercial device after aging without package protection.

EXAMPLE III

Chemiluminescent Green

| Inner Container Ingredients of Device of This Invention (Device VI) | | Outer Container Ingredients of Commercial Device (Device V) | |
|---|---|---|---|
| Dibutyl Phthalate | 86.462% | Dimethyl Phthalate | |
| 92.98% CPPO | 13.300% | CPPO | 7.00% |
| BPEA | 0.230% | BPEA | 0.11% |
| Sodium Salicylate | 0.008% | — | — |
| Inner Container 3.5 parts | | Inner Container 2.8 parts | |
| Outer Container 7.0 parts | | Outer Container 7.8 parts | |

CPPO = See Ex. 1
BPEA = 9,10-bis(phenylethynyl)anthracene

Again, the testing procedure of Example 1 is followed. The results are set forth in Table III, below.

TABLE III

| | Baseline | | Accelerated Aging 72 hours | | Accelerated Aging 96 hours | |
|---|---|---|---|---|---|---|
| | Device V | Device VI | Device V | Device VI | Device V | Device VI |
| Light Output in lumens/liter (at activation) | 2,000 | 2,000 | 0 | 2,000 | 0 | 2,000 |
| Total Light Output in lumens liter $^{-1}$ min. (for 10–720 minutes) | 16,620 | 15,550 | 19,535 | 17,720 | 19,020 | 17,650 |

As with previous comparisons, the commercial device exhibits a failure to produce light at activation upon aging before 10 minutes.

What is claimed is:

1. In a chemiluminescent light device comprising at least two containers each of which is sealed and each of which contain a chemical component of a multicomponent chemiluminescent system, said containers comprising a light transmitting outer container and at least one rigid frangible inner container located within said outer container, the improvement wherein said outer container has contained therein a diluent solution of peroxide and the inner container has contained therein a diluent solution of an oxalate, a fluorescer and a catalyst such that at least one of the chemical components of said multicomponent system does not undergo substantial deterioration.

2. A device according to claim 1 wherein said outer container is tubular means.

3. A device according to claim 1 wherein said outer container is plastic.

4. A device according to claim 1 wherein said outer container is polyethylene.

5. A device according to claim 1 wherein said frangible inner container is glass.

6. A device according to claim 1 wherein said diluents contain dibutyl phthalate.

7. A device according to claim 1 wherein said diluents contain dimethyl phthalate.

8. A device according to claim 1 wherein at least one of said diluents contains dibutyl phthalate.

9. A device according to claim 1 wherein said oxalate is bis(2,4,5-trichloro-6-carbopentoxyphenyl)oxalate.

10. A device according to claim 6 wherein said oxalate is bis(2,4,5-trichloro-6-carbopentoxyphenyl)oxalate.

11. A device according to claim 1 wherein said fluorescer is selected from the group consisting of 1-chloro-9,10-bis(phenylethynyl)anthracene; 9,10-bis(4-methoxyphenyl)-2-chloroanthracene and 9,10-bis(phenylethynyl)anthracene.

12. A device according to claim 11 wherein said diluent contains dibutyl phthalate.

13. A device according to claim 1 wherein said catalyst is sodium salicylate.

14. A device according to claim 1 wherein said fluorescer is a lower alkyl-9,10-bis(phenylethynyl)anthracene.

15. A device according to claim 14 wherein said fluorescer is 2-methyl-9,10-bis(phenylethynyl)anthracene.

16. A device according to claim 1 wherein said fluorescer is rubrene.

17. A method for the prevention of the deterioration of the catalyst, oxalate or fluorescer in a chemiluminescent light device comprising at least two containers each of which is sealed and each of which contains a chemical component of a multicomponent chemiluminescent system, said containers comprising a light transmitting outer container and at least one rigid frangible inner container located within said outer container which comprises sealing within said outer container a diluent solution of a peroxide and sealing within said inner container a diluent solution of an oxalate, a fluorescer and a catalyst.

18. A method according to claim 17 wherein said outer container is polyethylene.

19. A method according to claim 17 wherein said frangible inner container is glass.

20. A method according to claim 17 wherein at least one of said diluents contains dibutyl phthalate.

21. A method according to claim 17 wherein said oxalate is bis(2,4,5-trichloro-6-carboxypentoxyphenyl-)oxalate.

22. A method according to claim 17 wherein said fluorescer is selected from the group consisting of 1-chloro-9,10-bis(phenylethynyl)anthracene; 9,10-bis(4-methoxyphenyl)-2-chloroanthracene and 9,10-bis(-phenylethynyl)anthracene.

23. A method according to claim 17 wherein said catalyst is sodium salicylate.

24. A method according to claim 17 wherein said fluorescer is a lower alkyl-9,10-bis(phenylethynyl)anthracene.

25. A method according to claim 24 wherein said fluorescer is 2-methyl-9,10-bis(phenylethynyl)anthracene.

26. A method according to claim 17 wherein said fluorescer is rubrene.

* * * * *